US005465891A

United States Patent [19]

Bridges

[11] Patent Number: 5,465,891

[45] Date of Patent: Nov. 14, 1995

[54] BEVERAGE CONTAINER HOLDER

[75] Inventor: John A. Bridges, Nashville, Tenn.

[73] Assignee: Aladdin Industries, Inc., Nashville, Tenn.

[21] Appl. No.: 980,113

[22] Filed: Nov. 23, 1992

Related U.S. Application Data

[63] Continuation of Ser. No. 704,024, May 22, 1991, abandoned.

[51] Int. Cl.[6] ..... B60R 11/00

[52] U.S. Cl. ..... 224/566; 224/275; 224/483; 224/555; 224/901; 224/926; 220/738; 220/626; 248/346.11; 248/310

[58] Field of Search ..... 224/901, 42.42, 224/42.45 R, 42.43, 42.46 R, 275, 483, 555, 566, 926; 248/346.1, 310; 220/737, 738, 625, 630, 631, 636; 215/100.5; 229/1.5 H

[56] References Cited

U.S. PATENT DOCUMENTS

| | | | |
|---|---|---|---|
| 937,850 | 10/1909 | Parker . | |
| 1,389,594 | 9/1921 | Moore | 220/738 |
| 1,544,972 | 9/1924 | Gebelein . | |
| 1,922,127 | 8/1933 | Foley | 220/630 |
| 2,107,023 | 2/1938 | Bertsch . | |
| 2,117,180 | 5/1938 | Kronquest | 220/906 |
| 2,640,595 | 6/1953 | Byford . | |
| 2,767,563 | 10/1956 | Picascia | 220/630 |
| 2,799,147 | 4/1957 | Crawford, Jr. . | |
| 2,805,017 | 9/1957 | Hill et al. | 220/630 |
| 2,963,256 | 12/1960 | Borah . | |
| 3,051,303 | 8/1962 | Daanen et al. | 220/630 |
| 3,079,037 | 2/1963 | Schechter | 220/60 |
| 3,107,028 | 10/1963 | De Robertis . | |
| 3,250,422 | 5/1966 | Parish . | |
| 3,257,024 | 6/1966 | Semanchik . | |
| 3,273,739 | 9/1966 | Wei . | |
| 3,301,293 | 1/1967 | Santelli | 220/906 |
| 3,402,844 | 9/1968 | Chin | 215/100.5 |
| 3,456,864 | 7/1969 | Trombley et al. . | |
| 3,526,335 | 9/1970 | Swett et al. . | |
| 3,642,239 | 2/1972 | Zener, Jr. | 248/310 |
| 3,800,939 | 4/1974 | Cornelius | 224/901 |
| 3,808,084 | 4/1974 | Doty . | |

FOREIGN PATENT DOCUMENTS

| | | | |
|---|---|---|---|
| 3512808 | 10/1986 | Denmark . | |
| 030562 | 6/1981 | European Pat. Off. . | |
| 260055 | 3/1988 | European Pat. Off. . | |
| 1564560 | 4/1969 | France . | |
| 2628961 | 9/1989 | France . | |
| 102182 | 12/1916 | Guinea-Bissau . | |
| 457963 | 6/1950 | Italy . | |
| 9106445 | 5/1991 | WIPO . | |
| 3,949,876 | 4/1976 | Bridges et al. . | |
| 4,040,549 | 8/1977 | Sadler . | |
| 4,120,419 | 10/1978 | Saunders | 220/906 |
| 4,127,211 | 12/1978 | Zerby . | |
| 4,224,764 | 9/1980 | Dziewulski et al. | 248/346.1 |
| 4,299,161 | 11/1981 | Collias | 220/632 |
| 4,344,530 | 3/1988 | deLarosiere . | |
| 4,467,934 | 8/1984 | Hummer . | |

(List continued on next page.)

OTHER PUBLICATIONS

Page of Herrington catalog, Spring 1991.

*Primary Examiner*—Linda J. Sholl
*Attorney, Agent, or Firm*—Sandler, Greenblum & Bernstein

[57] ABSTRACT

A low profile beverage container holder having a base support for supporting the beverage container and a wall which extends around the base and thereby defines a cavity for receiving the beverage container. The holder is also provided with a wedging structure. In the preferred embodiment, the wedging structure comprises an annular rib disposed in the cavity and projecting upwards from the base support. Thus, when the beverage container is tipped, the annular rib contacts the concavity on the bottom surface or the beverage container and the container is thereby wedged between the annular rib and the low sidewall. A plurality of beverage containers which are adapted to be received within the beverage container holder are also disclosed.

45 Claims, 17 Drawing Sheets

FOREIGN PATENT DOCUMENTS 4,467,934 8/1984 Hummer ..... 224/42.46 R
4,517,851 5/1985 Tice .
4,573,597 3/1986 Adams et al. ..... 215/100 R
4,606,523 8/1986 Statz et al. .
4,607,758 8/1986 Stevens .
4,643,381 2/1987 Levy .
4,655,425 4/1987 Wallace et al. .
4,732,292 3/1988 Supik ..... 220/906
4,733,790 3/1988 Stein ..... 220/630
4,793,491 12/1988 Wolf et al. .
4,796,791 1/1989 Goss et al. .
4,829,618 5/1989 McKee .
4,898,297 2/1990 Wheeler .
4,919,381 4/1990 Buist .
4,928,876 5/1990 Marshall .
4,989,742 2/1991 Powell .
5,007,610 4/1991 Christiansen et al. .
5,031,774 7/1991 Morris et al. .
5,105,948 4/1992 Morris et al. .
5,115,937 5/1992 Chausse et al. .

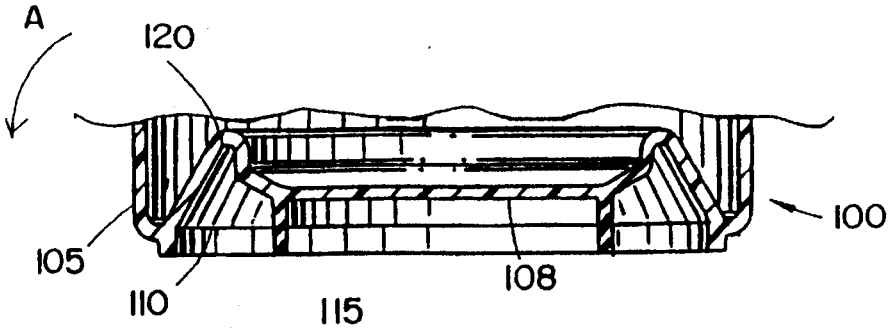
FIG. 10
FIG. 12
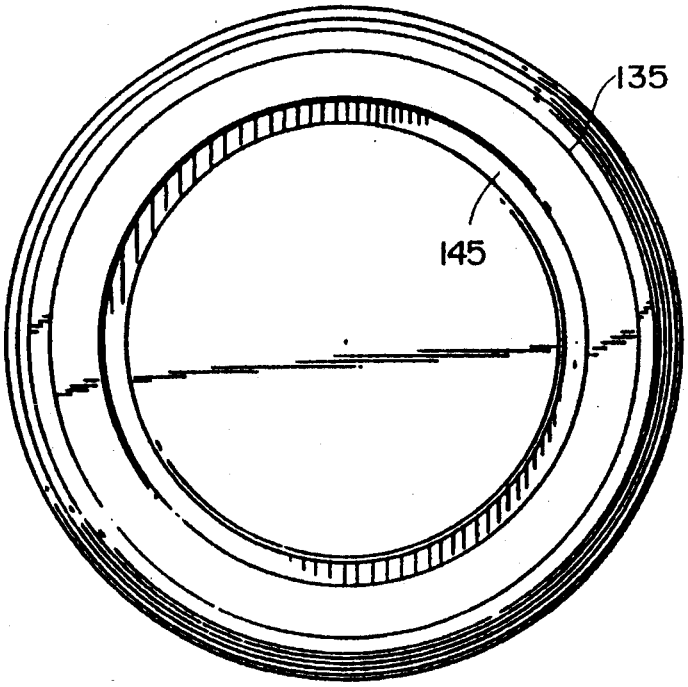
FIG. 13
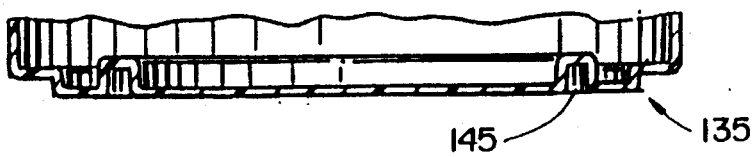

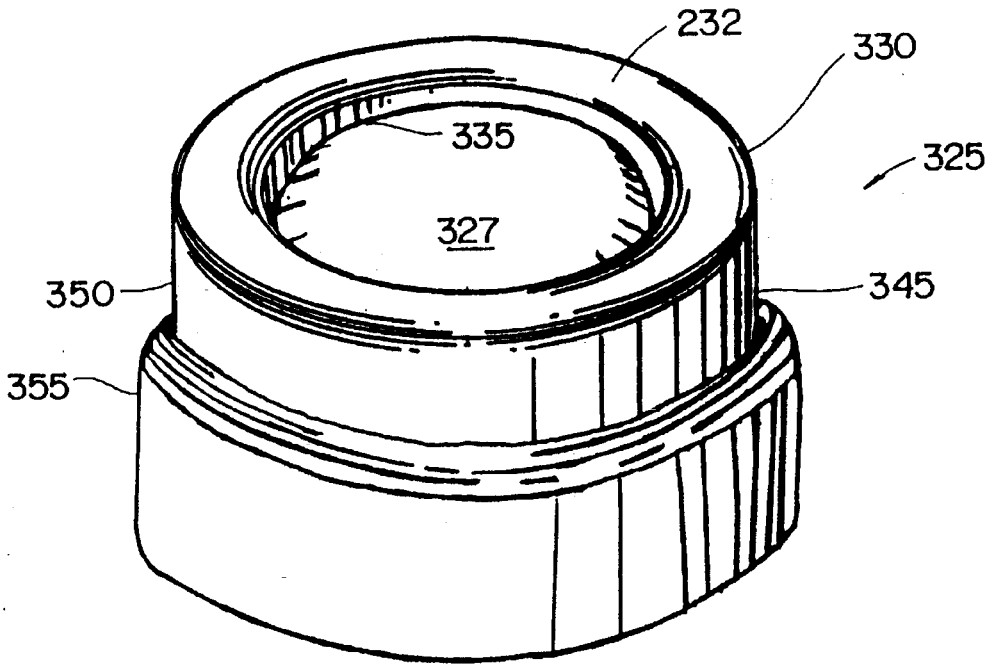
FIG. 28
FIG. 29
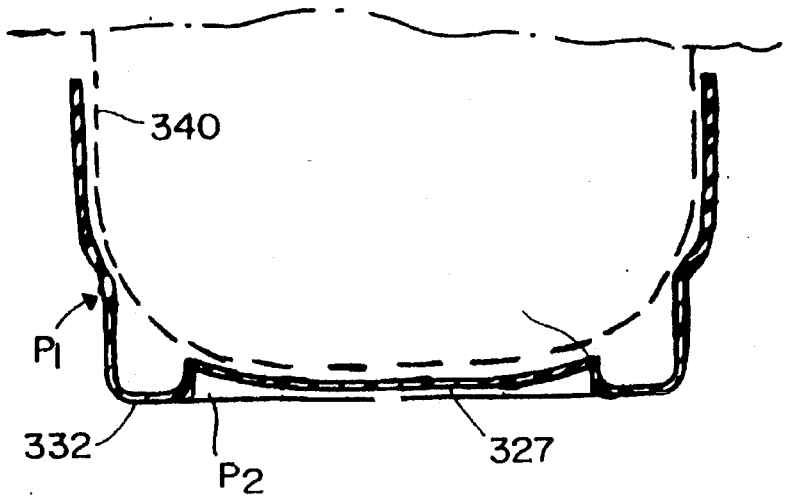

BEVERAGE CONTAINER HOLDER

This application is a continuation of application Ser. No. 07/704,024 filed May 22, 1991, now abandoned.

BACKGROUND OF THE INVENTION

The present invention generally relates to the construction of containers and a holder lot supporting the containers and, in particular, to the construction of beverage containers and a holder adapted to hold the containers in an upright position so as to prevent spillage. The beverage containers, such as mugs, paper cups, plastic cups, plastic beverage bottles and the like, have a base which is specifically adapted for use in the holder. The holder is a relatively small, unobtrusive device capable of holding a variety of beverage containers, as well as a standard 12 ounce aluminum can, and is particularly well suited for use in an automotive vehicle.

The habit of eating or drinking while driving or riding in an automobile has been present in society for many years, but never has it been a more common part of everyday life than in today's fast paced world. To meet this increased demand, a majority of fast food restaurants have added "drive-thru" windows enabling customers to receive their food and drinks without even leaving their vehicles. Convenience stores have also catered to this demand by providing commuters with a "come-back" deal that adds incentive for the commuter to return. Now, rather than leisurely drinking a cup of coffee at home, commuters are able to buy an insulated mug of coffee at the convenience store and then have it repeatedly refilled—and at a price which is probably less than what it would cost at home. A dilemma arises, however, from both such situations. Specifically, once the consumer is in the automobile and has the purchased beverage, there is no convenient location to place the beverage to prevent it from spilling while he is attempting to drive.

Heretofore, solutions to this problem have included holding the beverage between one's legs, propping the beverage against the back of the seat, setting the beverage in a drink well provided on the glove compartment door or using prior art devices designed to hang over the automobile door, such as those depicted in U.S. Pat. No. 4,655,425 to Wallace et al. or U.S. Pat. No. 4,606,523 to Statz et al. Both of these patents disclose plastic racks which encircle a beverage can and a hook which engages a window frame slot. However, these types of racks are generally not very secure, are limited to holding a standard 12-ounce can and, with the improved technology in window seal arrangements, it is not always possible to force the plastic hook between the window pane and the sealing gasket. Additionally, most prior art devices have required a substantial portion of the beverage container's overall height to be encircled in order for the beverage container to be adequately held. This requires a predetermined amount of space, makes the holder more obvious, and is less appealing to the consumer's aesthetic point of view. Thus, with few available alternatives for holding their beverages, consumers have come to accept a spilled drink, when making a sharp turn or accelerating into traffic, as an associated risk of consuming their coffee or soda while driving or riding in an automotive vehicle.

With literally hundreds of different beverage container shapes and sizes with which to contend, it would be near impossible to design a single holder which could accommodate such diversity. Therefore, what is needed is a holder adapted to secure a standardized aluminum can, which is also appealing to the consumer and which can be secured to virtually any planar surface. Then, once having designed a standardized holder, what is needed is a new approach to the manufacturing of various beverage containers such that they will also fit within the standardized holder and thereby be prevented from spilling.

SUMMARY OF THE INVENTION

Accordingly, it is an object of the present invention to provide a beverage container holder which is relatively small and attractive.

Another object of the invention is to provide a holder which may be removably secured in an automobile to prevent a standardized aluminum can or a variety of other beverage containers from spilling when the container is tipped, such as when making a sharp turn or sudden stop.

Another object of the invention is to provide a beverage container holder which may be built into the glove compartment door, console, armrest, dashboard, or any other suitable location in the interior of an automotive vehicle.

Another object of the invention is to provide a plurality of beverage container designs which are adapted to be securely held by the beverage container holder of the present invention.

These and other objects of the present invention are accomplished by providing a low profile beverage container holder for use with a standard aluminum can or a variety of other beverage containers. The holder includes base support means for supporting a beverage container, which has a base including a substantially vertical surface spaced inwardly from the container outer surface and extending upwardly from the container lower surface, and a low wall connected to the base and forming therewith a cavity for receiving the beverage container. The holder is also provided with wedging means for providing a wedging action against the substantially vertical surface of the beverage container, e.g., the generally concave portion on the bottom of an aluminum can. In a preferred embodiment, the wedging means comprises an annular rib disposed in the cavity and projecting upwards from the base support means. Therefore, when the beverage container is tipped, as when making a sharp turn or sudden stop, the annular rib contacts the substantially vertical surface on the bottom surface of the beverage container and the wall of the holder contacts the outer surface of the container thereby wedging the container between the annular rib and the wall. Thus, additional tipping of the beverage container is restrained and spilling or a beverage out of the container is prevented.

A beverage system according to the present invention further includes a plurality of beverage containers which are adapted to be received within the beverage container holder. One embodiment of the beverage container includes a lower base portion having a bottom support member with an inner recessed area such that an outer annular surface is formed. Thus, the outer annular surface on the beverage container bottom is received between the wall and wedging means of the beverage container holder, and is thereby wedged between the holder surfaces when tipped. Another embodiment of the beverage container provides an annular groove on the bottom surface such that the wall of the holder may be fitted therein. The wedging, in this instance, is only between the wall of the holder and the annular groove. Therefore, since the wedging means of the holder is not involved, this embodiment is not as effective as the first embodiment in preventing the spilling of beverages. The beverage container can be an insulated mug, a thin walled mug, a disposable plastic cup, a paper cup, a plastic tumbler, a foam cup or the like.

Another embodiment of the present invention provides an adapter which can be retrofit to an existing beverage container such that it may utilized in the holder of the present invention. The adapter includes a base member, a wall connected to the base and integrally joining therewith to thereby form a cavity for supporting the beverage container. The adapter further includes an inner recessed area in the base member such that an outer annular surface is formed. With this construction, an existing beverage container, having a base which includes a substantially vertical surface disposed inwardly from the container outer surface and extending upwardly from the container lower surface, can be adapted for use with the holder of the present invention, and thus, the manufacturing of beverage containers can become standardized.

BRIEF DESCRIPTION OF THE DRAWINGS

The novel features of the present invention are set out with particularity in the appended claims, but the invention will be understood more fully and clearly from the following detailed description of the invention as set forth in the accompanying drawings, in which:

FIG. 10 is a cross-sectional view of a beverage container adapted for use in the holder of FIG. 1 according to another embodiment of the present invention;

FIG. 12 is a bottom plan view of the beverage container shown in FIG. 11;

FIG. 13 is a cross-sectional view taken generally through the base of the beverage container shown in FIG. 11;

FIG. 28 is a perspective view of a base support member for a bottle which is configured for use in the holder shown in FIG. 1;

FIG. 29 is a cross-sectional view taken generally through the base of FIG. 28 with a bottle shown in phantom therein;

DETAILED DESCRIPTION OF PREFERRED EMBODIMENTS

Figure 1:
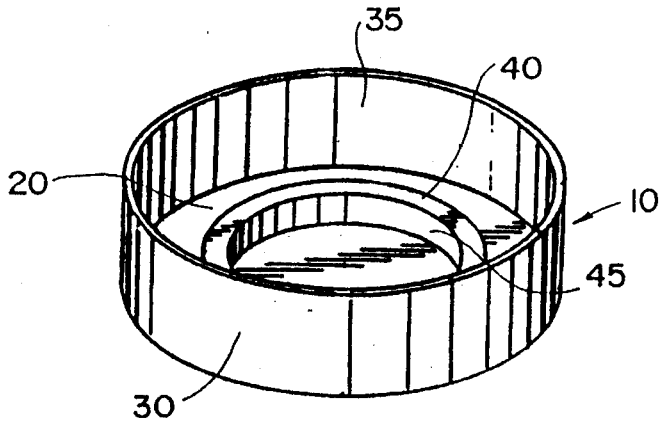
FIG. 1 is a perspective view illustrating the beverage container holder of the present invention.
Figure 2:
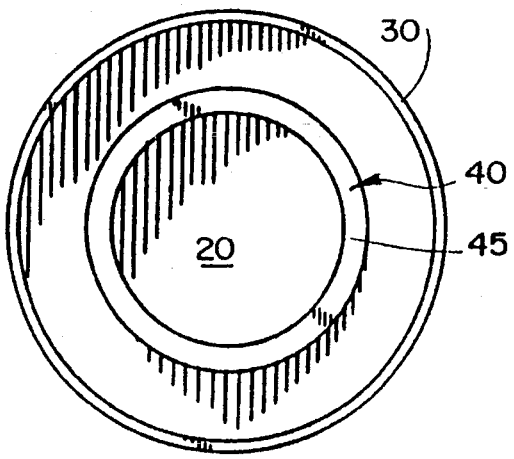
FIG. 2 is a top plan view of the holder shown in FIG. 1.
Figure 3:
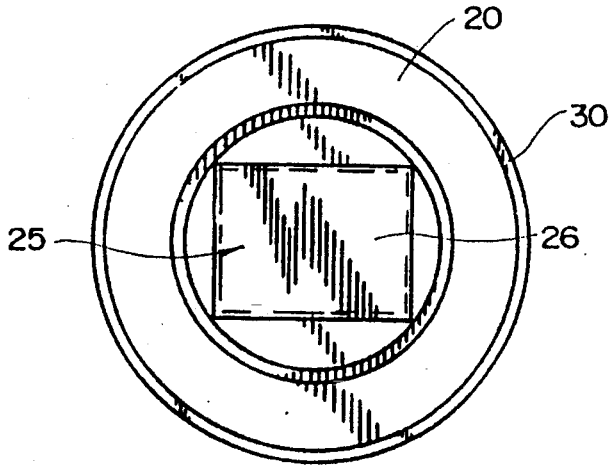
FIG. 3 is a bottom plan view of the holder shown in FIG. 1 including an optional adhesive tab secured thereto.
Figure 4:
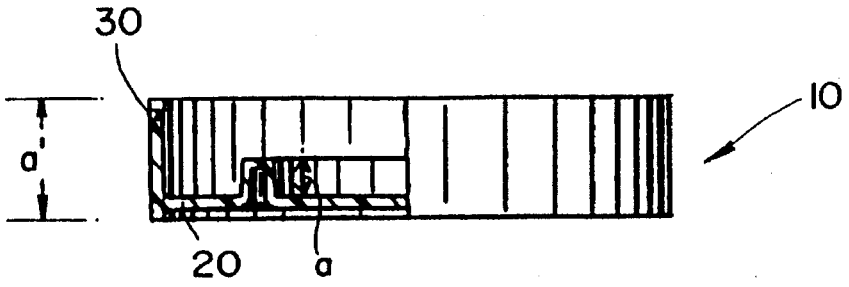
FIG. 4 is a side elevational view showing a partial cross section of the holder shown in FIG. 1.
Figure 5:
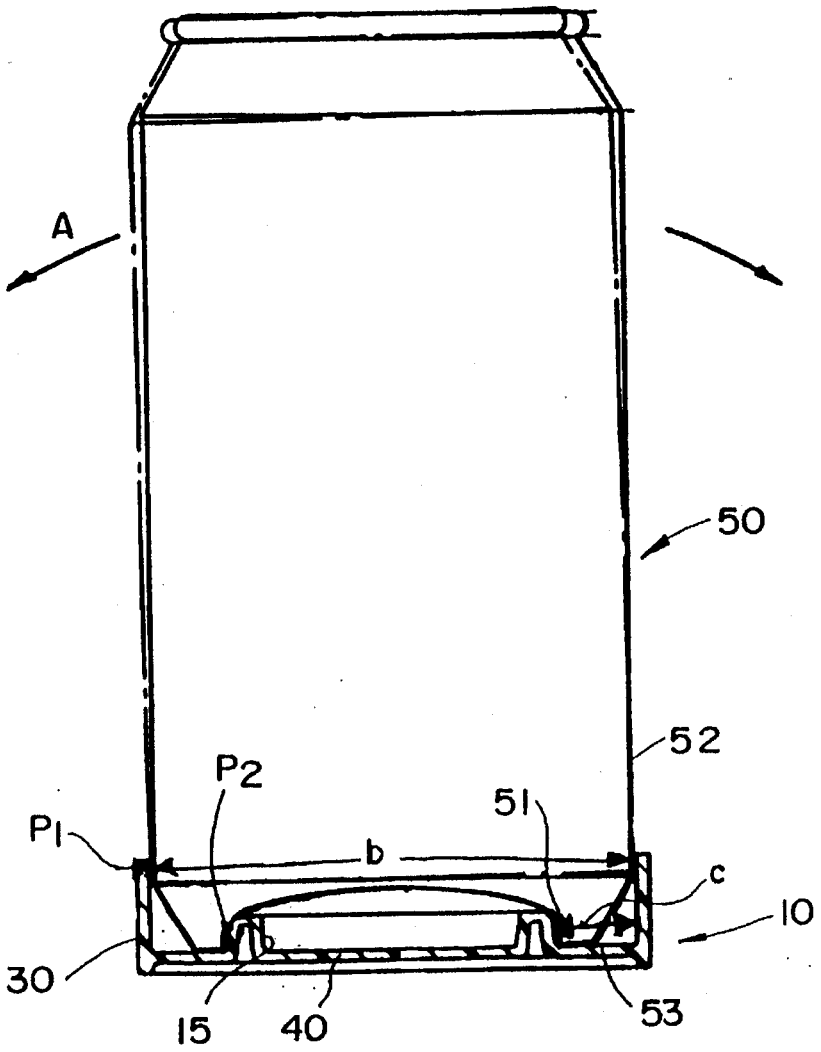
FIG. 5 is a sectional view of the holder shown in FIG. 1 when used with an aluminum can.
Figure 6:
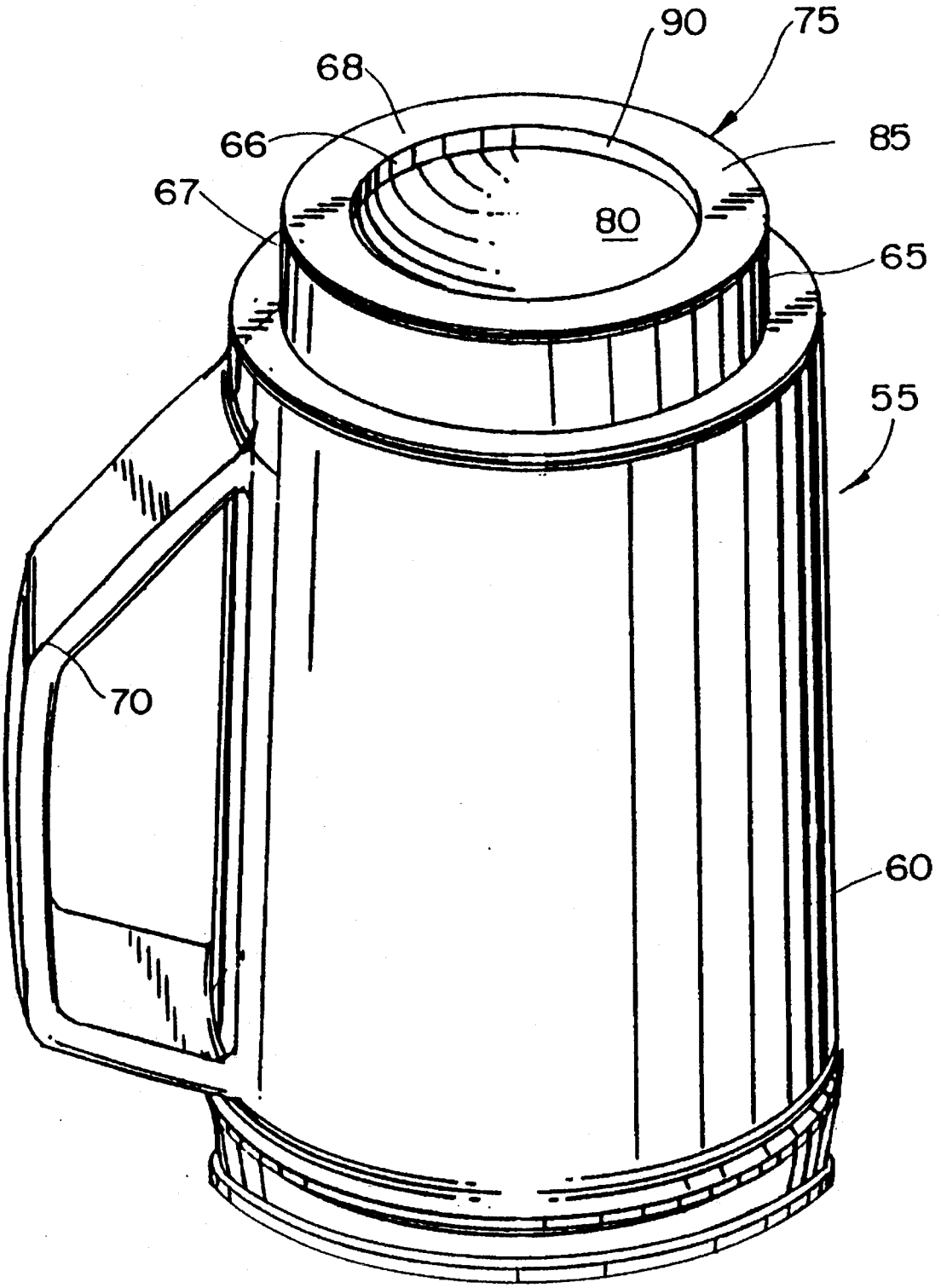
FIG. 6 is a bottom perspective view of a beverage container adapted for use in the holder of FIG. 1 according to one embodiment of the present invention.
Figure 7:
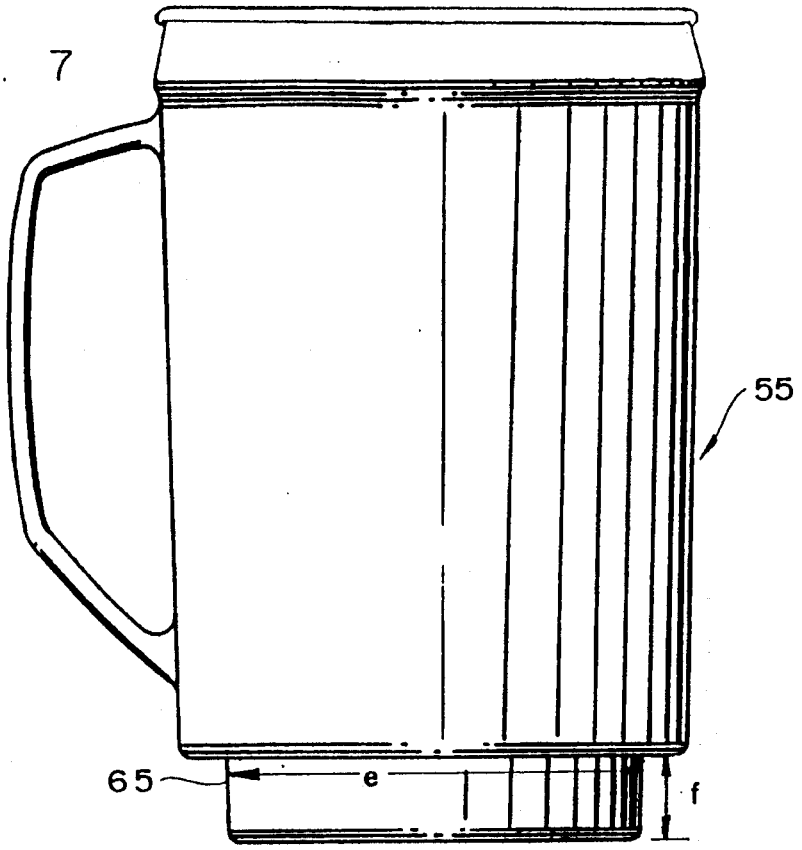
FIG. 7 is a side elevational view of the beverage container shown in FIG. 6.

Referring to FIGS. 1–3, a beverage container holder 10 comprises base support means 20 for supporting a beverage container, a wall 30 connected thereto and forming therewith a cavity 35 for receiving the base of the beverage container, and wedging means 40 which provides a wedging action against the beverage container when it is tipped and thereby prevents it from further tipping and spilling the beverage therein. As shown, the wedging means of a preferred embodiment comprises an annular rib 45 which is disposed within beverage receiving cavity 35 and projects slightly upwards from base support means 20. As shown in FIG. 4, wall 30 defines the lower surface of holder 10 such that base support means 20 is disposed above a support surface. As also shown, the height "a" of annular rib 45, is preferably on the order of 0.140 inch plus or minus 5 one-thousandths, although other heights are of course possible. The preferred diameter "b" of holder 10 is approximately 2.615 inches plus or minus 5 one-thousandths, which as illustrated in FIG. 5, generally corresponds to the diameter of a standardized aluminum can. The distance "c", between the interior side of wall 30 and the side of annular rib 45 facing wall 30, is approximately 0.392 inch plus or minus 5 one-thousandths. The base of the beverage container or aluminum can 50, has a substantially vertical surface 51 which is disposed inwardly from a container outer surface 52 and extends upwardly from a container lower surface 53. As shown, the distance "e" generally corresponds to the distance between outer surface 52 of aluminum can 50 and substantially vertical surface 51 spaced inwardly therefrom. When aluminum can 50 is placed in holder 10 and is tilted in the direction of arrow A, a wedging force is created between can 50 and holder 10. The wedging is created by the contact of can 50 with wall 30 at a first point P1 and due to the contact of substantially vertical surface 51 with wedging means 40 at a second point P2. Therefore, when aluminum can 50 begins to tip, a wedging action at contact points P1 and P2 prevents can 50 from tipping further over, and thereby hold the can in an upright position. In addition, the more can 50 is tilted, the greater the wedging force becomes. However, can 50 can only tip between 3° and 8° from its longitudinal axis before the wedging will restrain it.

The wedging action of contact points P1 and P2 allows wall 30 to have a relatively low height and to still adequately support aluminum can 50. As shown in FIG. 4, the height "d" of wall 30 is generally on the order of 0.5 inch from the top surface of base support means 20, in the preferred embodiment. This provides holder 10 with a generally low profile and therefore, since it is not extremely obvious, its use is not objectionable. In a preferred embodiment, holder 10 may also be provided with an adhesive tab 25, so that it may be removably secured to any planar surface. Prior to use, a removable film 26 is provided on adhesive tab 25 to protect it. When it is desired to install holder 10, this film is easily peeled away, and the holder may be secured to the desired surface. Due to its relatively low profile and its aesthetic appeal, holder 10 is well suited for use in an automotive vehicle, or boat, where its use cannot be hidden from view and there is generally no convenient location for placing a beverage container.

Referring to FIG. 6–9, the preferred embodiment of a beverage container, such as a mug, for use with beverage container holder 10, is shown. Beverage container 55 comprises an upper portion 64 for holding the actual beverage, a base portion 65 connected to upper portion 64 and including a substantially vertical surface 66 disposed inwardly from the container outer surface 67 and extending upwardly from the container lower surface 68, and optionally, a handle 70. Base portion 65 includes a bottom support member 75 that has a recessed area 80 such that an outer annular surface 85 is thereby formed. The diameter "e" of base portion 65 is approximately 2.60 inches, which corresponds to the dimensions of a standard aluminum can, and which allows beverage container 55 to be loosely fit within holder 10. Similarly, the height "f" of base portion 65 is approximately 0.50 inch which corresponds to the height of wall 30 above base support means 20 of holder 10. Substantially vertical surface 66, forming the inner wall of outer annular surface 85, has a height which generally corresponds to that of wedging means 40 of holder 10. In a preferred embodiment, a 90° angle is formed between annular surface 85 and surface 66. This provides a vertical surface which contacts wedging means 40 of holder 10. Thus, when beverage container 55 is tipped within holder 10, vertical surface 66 contacts wedging means 40 and outer wall 67 contacts wall 30, thereby obtaining a secure wedging action.

Upper portion 60 of beverage container 55, as illustrated, is merely representative of the various constructions which may be utilized. Base portion 65 is required to have a height of at least 0.5 inch; however, the dimensions or configurations of the upper portion, once above said 0.5 inch, are not essential to the proper functioning and utilization of the present invention.

Figure 8:
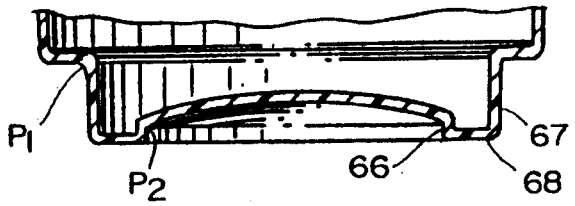
FIG. 8 is a cross-sectional view taken generally through the base of the beverage container shown in FIG. 6.
Figure 9:
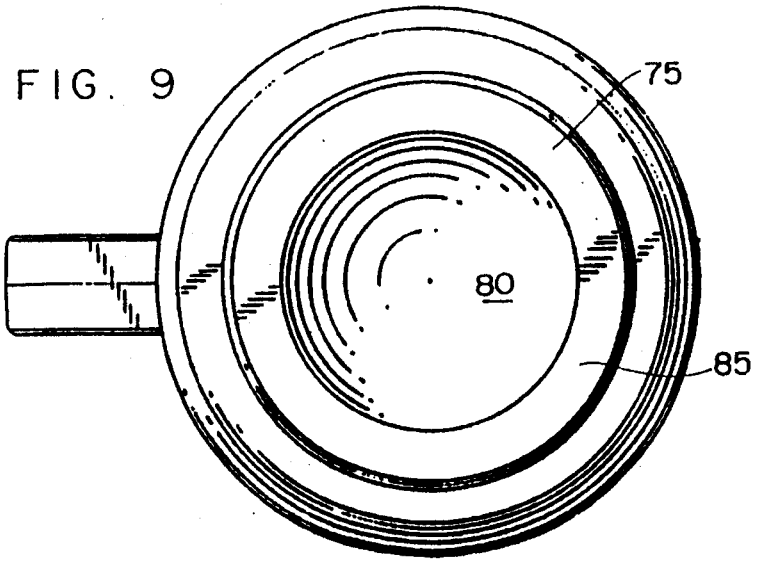
FIG. 9 is a bottom plan view of the beverage container shown in FIG. 6.

When beverage container 55 is disposed within holder 10 and tipped such as in a normal occurrence of everyday driving, a wedging action occurs between contact points P1 and P2 of container 55, as shown in FIG. 8, and the same points P1 and P2 of holder 10, as illustrated in FIG. 5. Thus, beverage container 55 will be prevented from further tipping and thereby spilling the beverage therein.

An alternative base portion 100 is illustrated by FIG. 10. In this embodiment, an outer skirt 105 is provided which virtually conceals holder 10 when the beverage container is placed therein. Base portion 100 includes outer skirt 105, an annular ring 115 depending from a central base member 108, and means defining a container holder receiving groove 110 therebetween. The depth of groove 110 gradually increases from the outer surface of annular ring 115 such that it is above central base member 108, sharply rises in an almost vertical direction to form dip 120 having a maximum depth, and then sharply decreases to thereby join skirt 105 at the bottom surface of base 100. When base 100 is placed within holder 10, wall 30 of holder 10 is received at the maximum depth of dip 120, and annular ring 45 is disposed interior to and adjacent to annular ring 115 of base 100. Thus, when a beverage container having base 100 is tipped in the direction of arrow A, contact points P1 and P2 of base 100 engage holder 10 and thereby create a wedging action which prevents any further tipping of the container, and thus, prevents the spilling of the container's contents.

Figure 11:
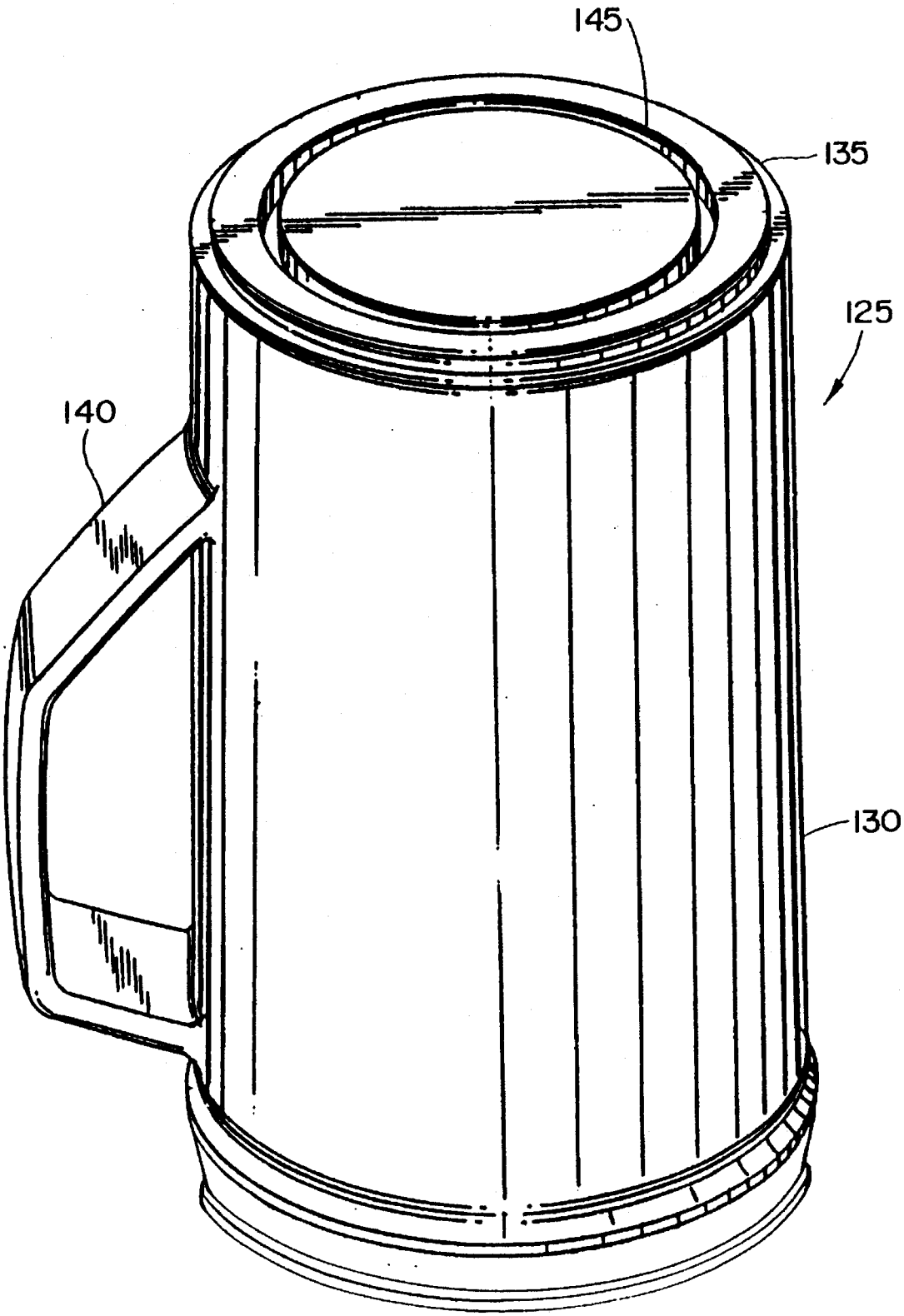
FIG. 11 is a bottom perspective view of a beverage container adapted for use in the holder of FIG. 1 according to another embodiment of the present invention.

Another alternative for a beverage container, such as a mug, is illustrated in FIG. 11. Beverage container 125 includes an upper portion 130, a base portion 135 and an optional handle 140. In this instance, base portion 135 has an annular groove 145, the diameter of which is generally configured so as to receive holder 10 therein. When beverage container 125 is disposed within holder 10, wall 30 of holder 10 is disposed within annular groove 145, and thereby secures container 125 in place. The tipping of beverage container 125 causes annular groove 145 to contact wall 30 of holder 10 at point P1. However, in this instance, there would be no contact between beverage container 125 and annular rib 45 of holder 10. Therefore, although a beverage container can be secured by merely engaging wall 30 of holder 10, there is no wedging action between a substantially vertical wall and wedging means 40. Therefore, the effectiveness of holder 10 to prevent container 125 from tipping is diminished as compared to the above embodiments.

Figure 14:
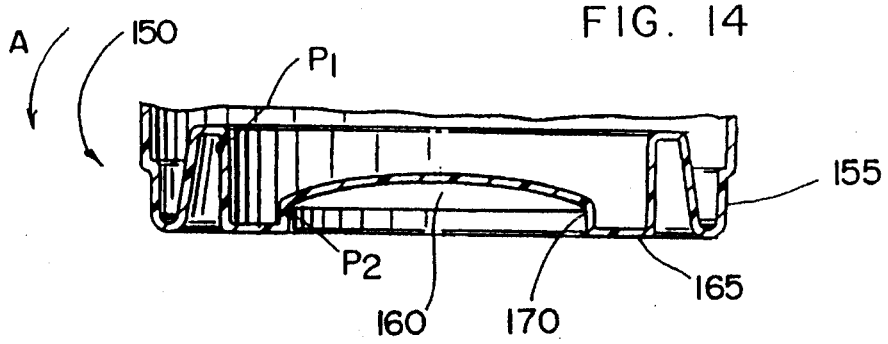
FIG. 14 is a cross-sectional view taken generally through the base of a beverage container adapted for use in the holder of FIG. 1 according to another embodiment of the present invention.

An alternative embodiment for a base of a beverage container is illustrated in FIG. 14. Base 150 is similar to base portion 65 of FIG. 6; however, in this instance, an outer skirt 155 is provided. Similar to FIG. 6, base 150 comprises an inner recessed area 160 which thereby forms an outer annular surface 165. Inner wall 170 of annular surface 155 is generally vertically disposed so as to firmly contact wedging means 40 of holder 10. When a beverage container having a base 150 is seated within holder 10, base 150 and holder create a wedging force between common points P1 and P2, when beverage container 150 is tipped in the direction of arrow A. Thus, spilling of the beverage is prevented. Base 150 further includes an outer peripheral skirt 155 such that when a beverage container is seated within holder 10, the holder will virtually be concealed from view.

Figure 15:
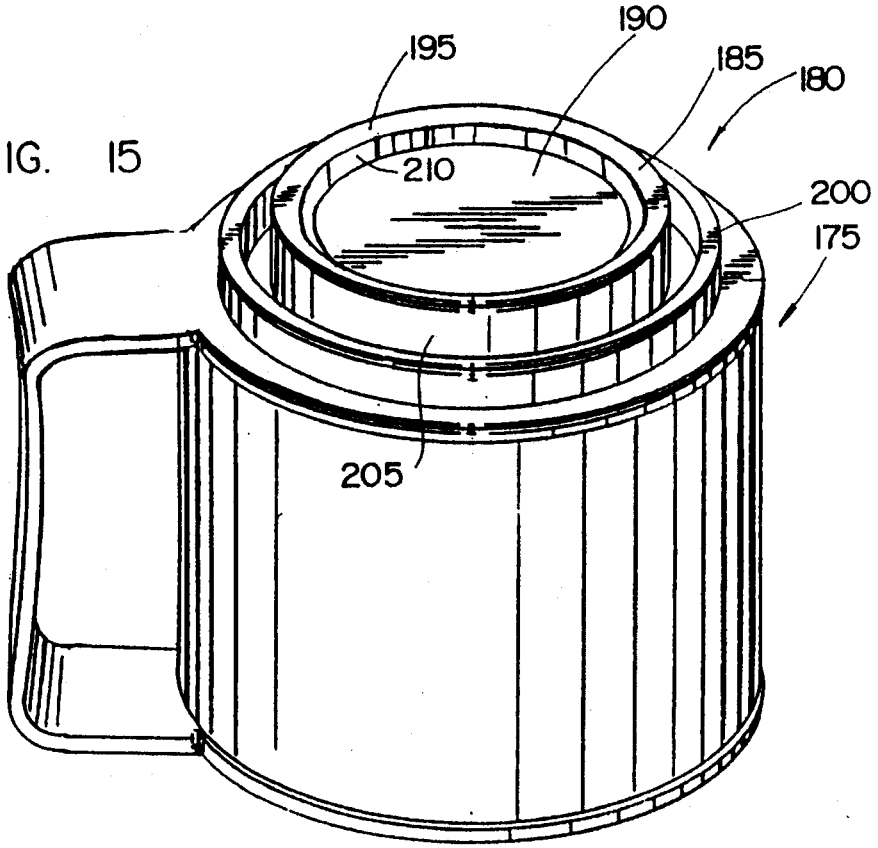
FIG. 15 is a bottom perspective view of a beverage container adapted for use in the holder of FIG. 1 according to another embodiment of the present invention.
Figure 16:
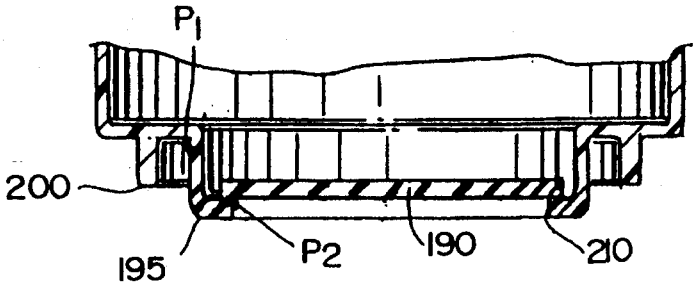
FIG. 16 is a cross-sectional view taken generally through the base of the beverage container shown in FIG. 15.

FIGS. 15 and 16 illustrate a revised design for a popular low profile insulated mug, namely a "Stanley" mug. Mug 175 comprises a base portion 180 having a bottom support member 185 and an outer annular ring 200 spaced therefrom. Bottom support member 185 further includes an inner recessed area 190 which thereby forms an outer annular surface 195. The dimensions of bottom support member 185 are such that annular surface 195 will be seated between wall 30 and annular rib 45 when mug 175 is placed within holder 10. Specifically, outer wall 205 of annular surface 195 will be adjacent to the inner side of wall 30 of holder 10 and inner sidewall 210 of annular surface 198 will be adjacent to the outer surface of annular rib Thus, when mug 175 is tilted counter-clockwise, a wedging effect is obtained due to inner sidewall 210 contacting holder 10 at point P2 and outer wall 205 contacting holder 10 at point P1, wherein points P1 and P2 for holder 10 are the same as those shown in FIG. 5.

Figure 17:
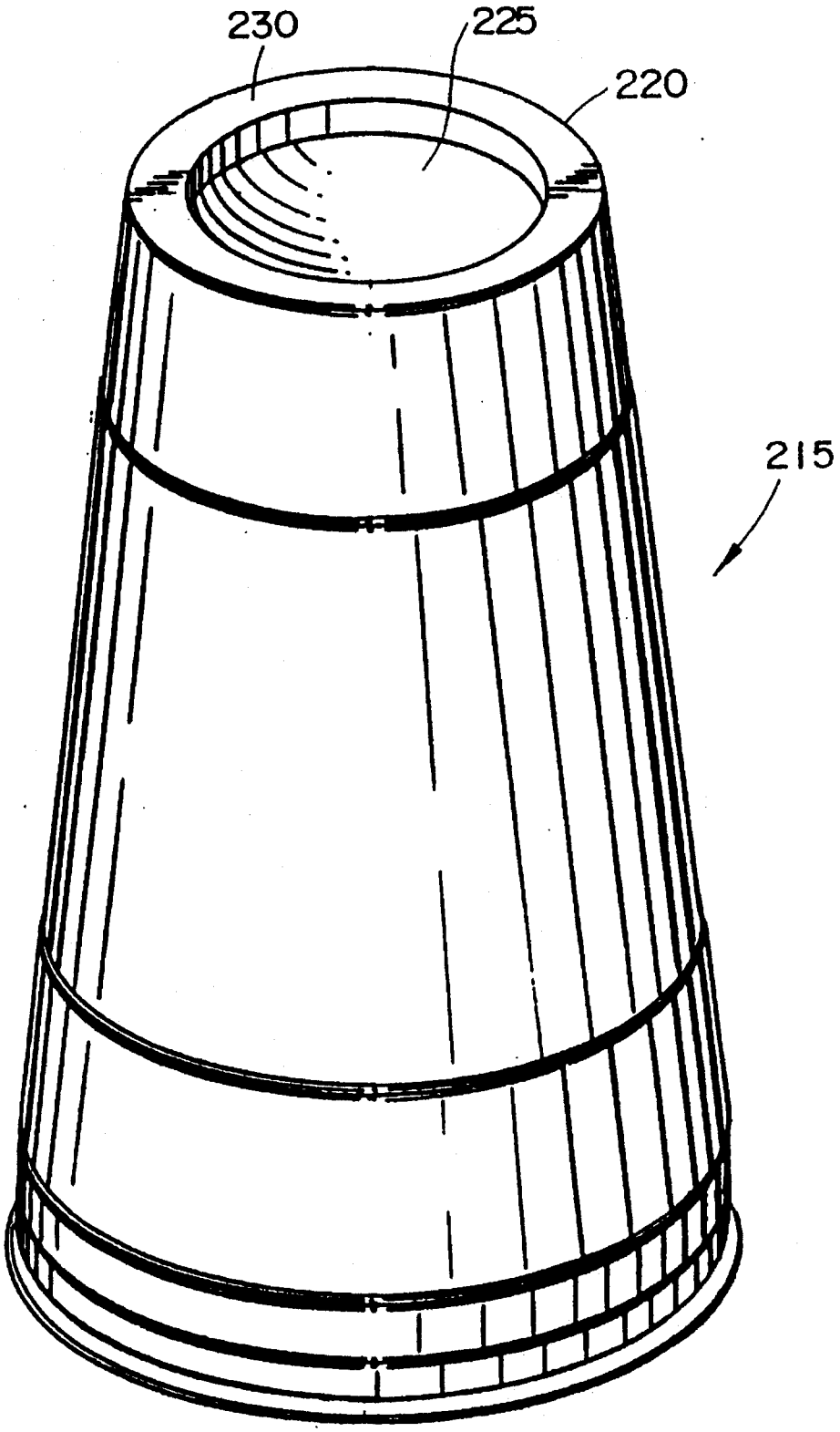
FIG. 17 is a bottom perspective view of a beverage container adapted for use in the holder of FIG. 1 according to another embodiment of the present invention.
Figure 18:
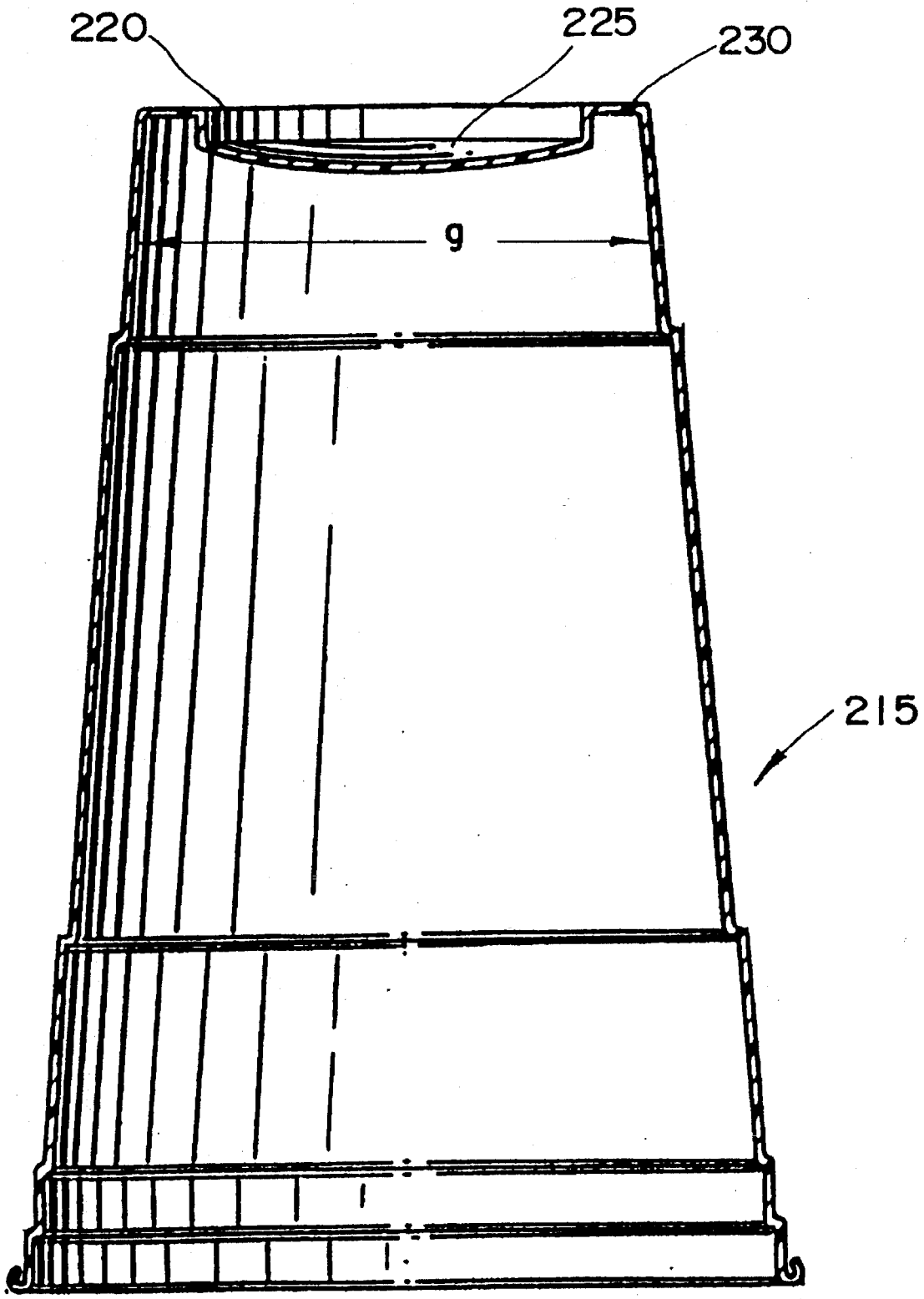
FIG. 18 is a cross-sectional view taken generally through the beverage container shown in FIG. 17.

A beverage container, such as a cup, which is adapted to be seated within holder 10 is illustrated in FIG. 17 according to the present invention. Beverage container 215 comprises a bottom support surface 220 including an inner recessed area 225 which thereby forms an outer annular surface 230. The outer diameter of cup 215, approximately 0.5 inch from the bottom surface thereof, is 2.60 inches, which generally corresponds to the diameter of a standardized aluminum can. Additionally, the width of annular surface 230 generally coincides to the distance between wall 30 and annular rib 45 of holder 10. Thus, when cup 215 is seated within holder 10, a positive wedging action is obtained to thereby prevent the spilling of the beverage.

Figure 19:
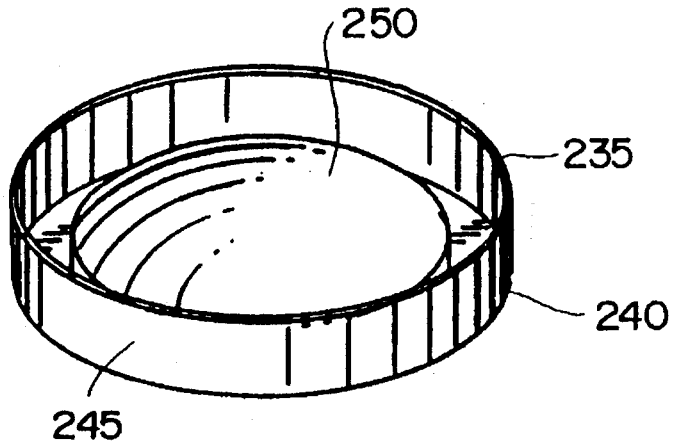
FIG. 19 is a perspective view of an adapter for use with the holder of FIG. 1.
Figure 20:
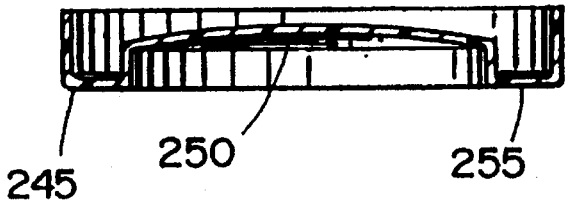
FIG. 20 is a cross-sectional view taken generally through the adapter shown in FIG. 19.

The present invention further includes an adapter which may be fitted onto existing beverage containers, such as cups, so that they may be utilized with holder 10. Adapter 235, as illustrated in FIGS. 19 and 20 includes a base member 240 and a wall 245 connected to base 240 and integrally joining therewith to thereby form a cavity for supporting a beverage container. The inner portion 250 of base member 240 is projected upwards from the bottom surface such that portion 250 forms a raised surface within wall 245. The remaining annular bottom surface 255 positively secures adapter 235 within holder 10 when it is placed therein. By using adapter 235, virtually any beverage container having a base diameter of less than 2.6 inches can be modified, subsequent to production, for utilization with holder 10.

Figure 21:
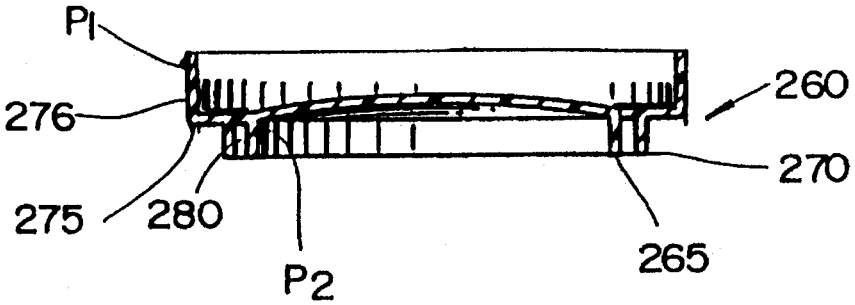
FIG. 21 is a cross-sectional view of an adapter for use with the holder of FIG. 1 according to another embodiment of the present invention.
Figure 22:
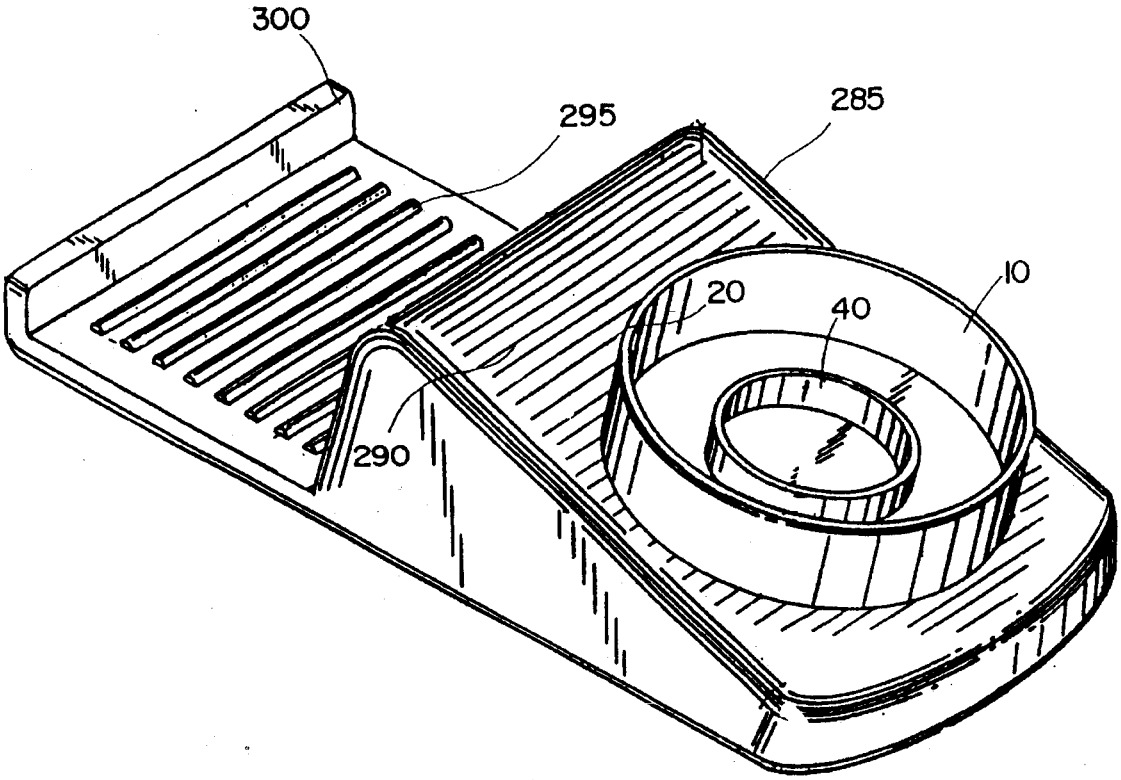
FIG. 22 is a perspective view of the holder of FIG. 1 according to another embodiment of the present invention.
Figure 23:
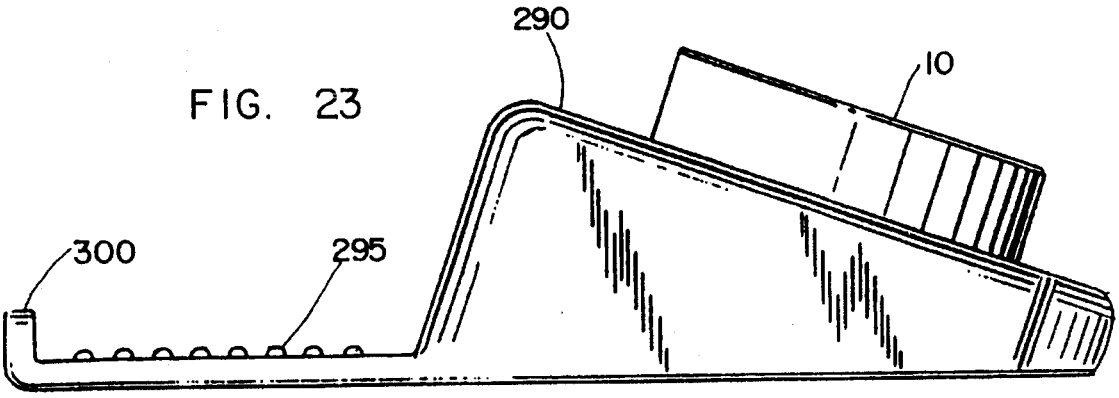
FIG. 23 is a side elevational view of the holder shown in FIG. 22.
Figure 24:
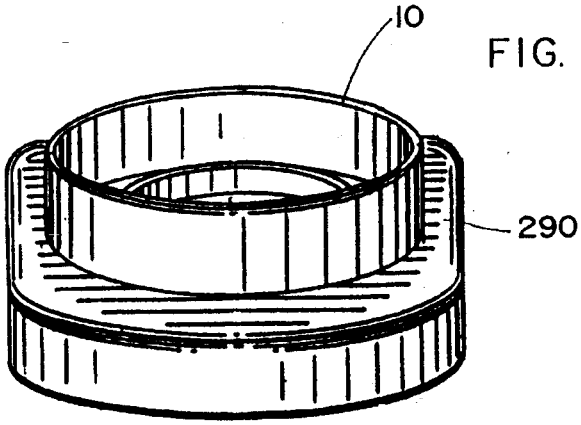
FIG. 24 is a front elevational view of the holder shown in FIG. 22.

An alternative embodiment of an adapter is illustrated by FIG. 21. Adapter 260 comprises base means 275 and two projecting annular rings 265 and 270 which depend therefrom. When adapter 260 is seated within holder 10, projecting ring 265 is disposed around the periphery of annular rib 45 and outer surface 276 is adjacent to wall 30 of holder 10. When a beverage container with adapter 260 attached thereto is seated within holder 10 and tipped in a counter-clockwise direction, wedging occurs between point P1 and P2, as shown in FIG. 21, and analogous points P1 and P2 of holder 10, as shown in FIG. 5. In this manner any further tipping of a beverage container is prevented and thus, the beverage therein does not spill.

Additionally, projecting ring 270 is provided to increase the stability of a beverage container attached to adapter 260 when adapter 260 is placed on a flat surface, rather than in holder 10. The space 280 between projecting rings 265 and 270 is not limited to any specific dimension. However, the greater distance between rings 265 and 270, the greater the stability of adapter 260 will be when disposed on a planar surface.

The beverage container holder illustrated in FIG. 1 is ideally suited to be secured on a planar surface such as the dashboard of a car. However, since not all dashboards have a generally horizontal surface on which to place said holder, several alternative embodiments are provided.

Figure 25:
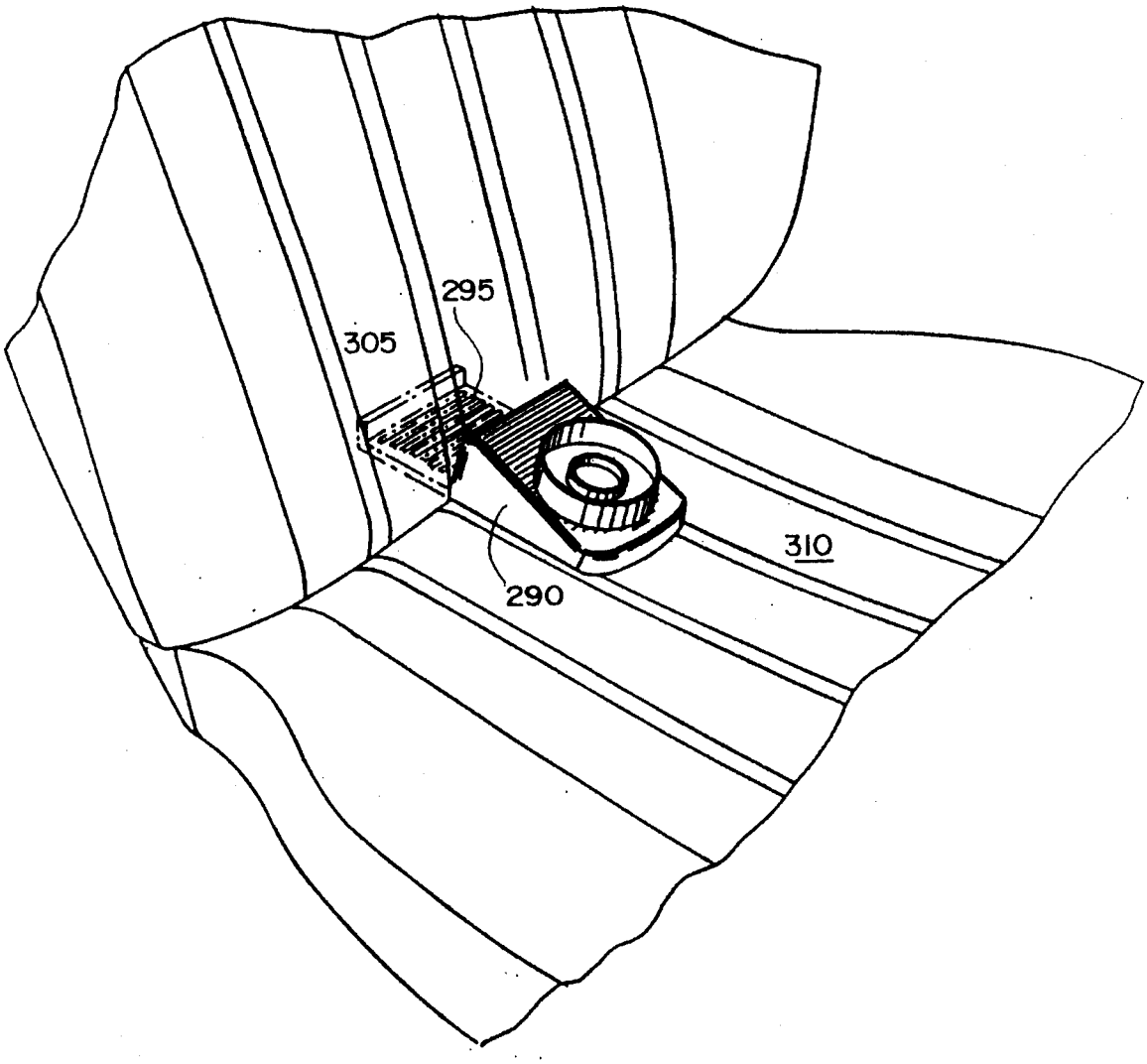
FIG. 25 is a perspective view showing the holder of FIG. 22 when in use in an automobile.

In FIGS. 22–25, beverage container holder 10 is integrally molded with support structure 285. Support structure 285 comprises an inclined frontal surface 290 and a generally flat rear surface 295 which terminates in an upwardly turned lip 300. As best shown in FIG. 25, rear surface 295 is adapted to be inserted between a back cushion 305 and a seat cushion 310 of an automotive vehicle. The remaining frontal surface 290 projecting outwards from back cushion 305 is generally inclined to compensate for the rearward sloping of seat cushion 310. Thus, when a beverage container is seated within the holder, it will be supported in a relatively upright position and spilling will be prevented.

Figure 26:
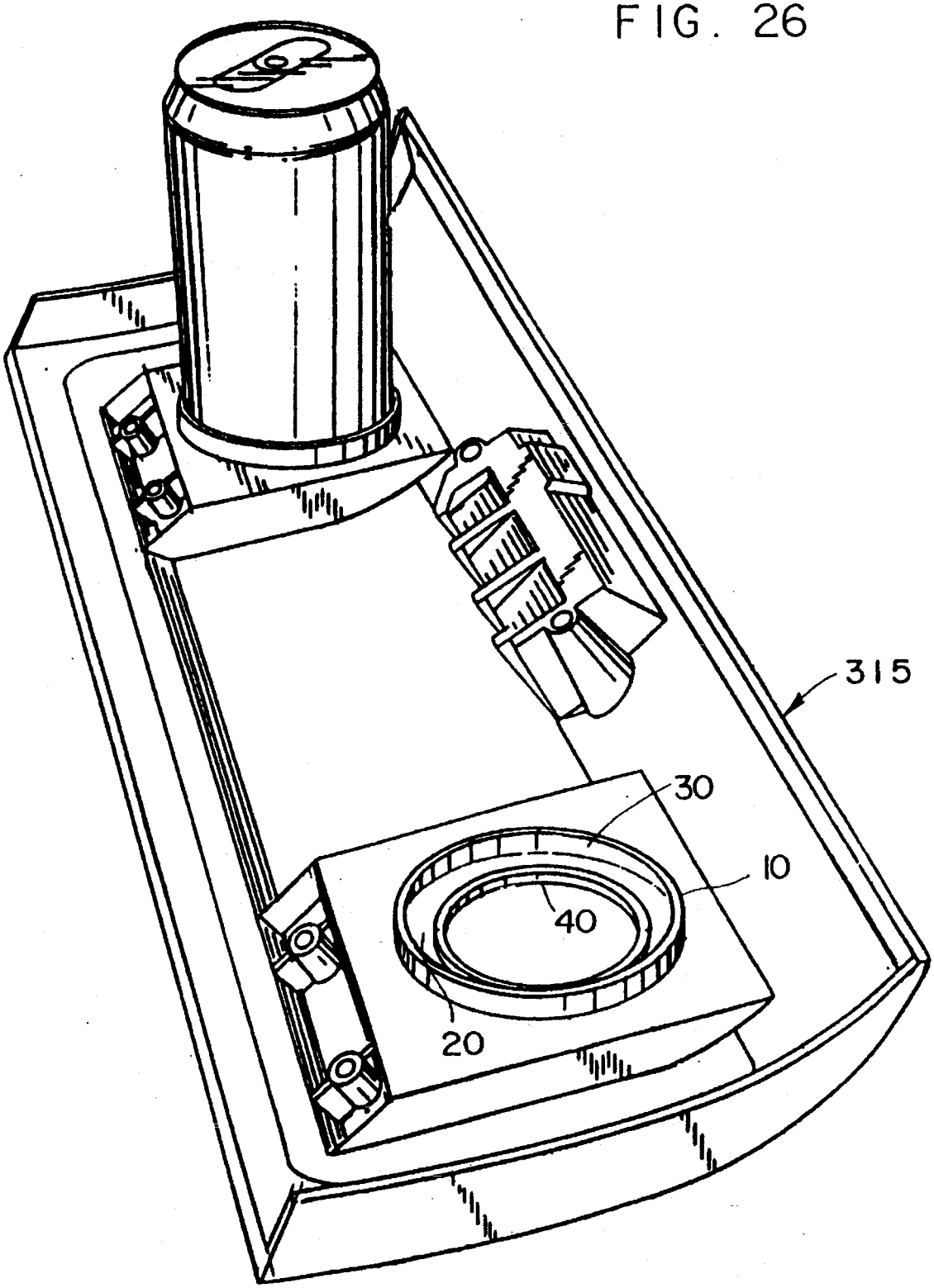
FIG. 26 is a perspective view of the beverage container holder shown in FIG. 1 according to another embodiment of the present invention.
Figure 27:
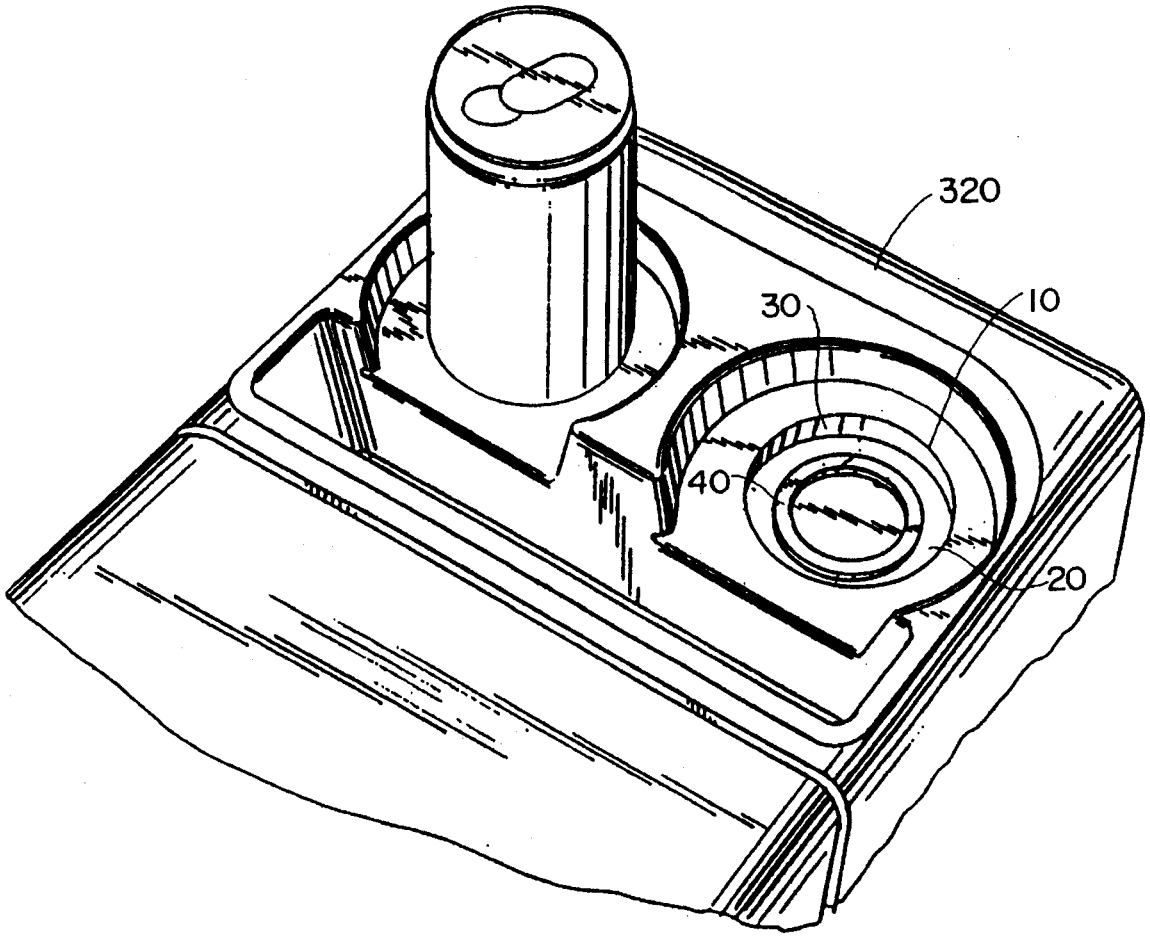
FIG. 27 is a perspective view of the beverage container holder shown in FIG. 1 according to another embodiment of the present invention.

Just as the above description of various beverage containers according to the present invention has offered a new approach to beverage container manufacturers for the standardization thereof, FIGS. 26 and 27 suggest a new approach to the automotive industry for the standardization of built-in beverage container holders. FIG. 26 illustrates a beverage container holder 10 which has been integrally formed with the door 315 of an automobile glove compartment. Alternatively, since other locations within a vehicle interior may be preferred, FIG. 27 illustrates a beverage container holder 10 which has been integrally formed with a console 320 of an automotive vehicle. Other locations within the interior of an automotive vehicle, such as dashboards or armrests, may of course also be chosen as a suitable location on which to "build-in" holder 10, or to otherwise integrally form holder 10 therewith. These embodiments entail very little cost or additional labor for the automotive industry; however, the advantages to the consumer are immense.

Thus, with the standardization of beverage containers, as discussed above, and with built-in holders to receive such standardized containers, the risks of spilled beverages while driving can be sharply diminished. Still further, it is conceivable that cups from fast food restaurants could be adapted for the built-in beverage holders, plastic beverage bottles, and even the insulated mugs provided by various convenience stores and retail outlets could be standardized such that they may all be utilized with the built in or removably secured holder of the present invention.

Further embodiments of the present invention relate to the configuration of bottles for use within beverage container holder 10 of FIG. 1. This may accomplished in a variety of ways. According to one embodiment of the invention, the base support cup in which the bottle is disposed is configured to be received with the holder. In two additional embodiments, the bottle itself is configured such that it can be placed directly in the holder without the use of a base support cup.

FIGS. 28 and 29 illustrate the configuration of a beverage container support cup, and more particularly a bottle support cup, according to the present invention. As shown, beverage container support cup 325 comprises a base 330 having a substantially vertical surface 335, which cooperates with wedging means 40 of holder 10 when a bottle having cup 325 is placed therein, and a wall 345 which is connected to base 330 and joins therewith to form a cup recess which receives bottle 340. Base 330 further includes a central base member 327 and an annular surface 332 depending from the outer periphery of central base member 327 to thereby define a lower surface. Annular surface 332 also forms substantially vertical surface 335 that cooperates with wedging means 40. Wall 345 further includes a lower wall portion 350 having a diameter generally corresponding to cavity 35 of holder 10 and an upper wall portion 355 having a diameter which generally corresponds to that of bottle 340. Lower wall portion 350 has a preferred height of approximately 0.5 inch which generally corresponds to that of wall 30 of holder 10. Therefore, when beverage container support cup 325 is placed in holder 10, and bottle 340 within cup 325 is tilted counter-clockwise about a longitudinal axis thereof, substantially vertical wall 335 will contact wedging means 40 at point P2 and lower wall portion 350 will contact wall 30 at point P1. Thus, beverage container support cup 325 will be wedged within holder 10 and thereby prevented from tipping any further and spilling the contents of bottle 340.

Figure 30:
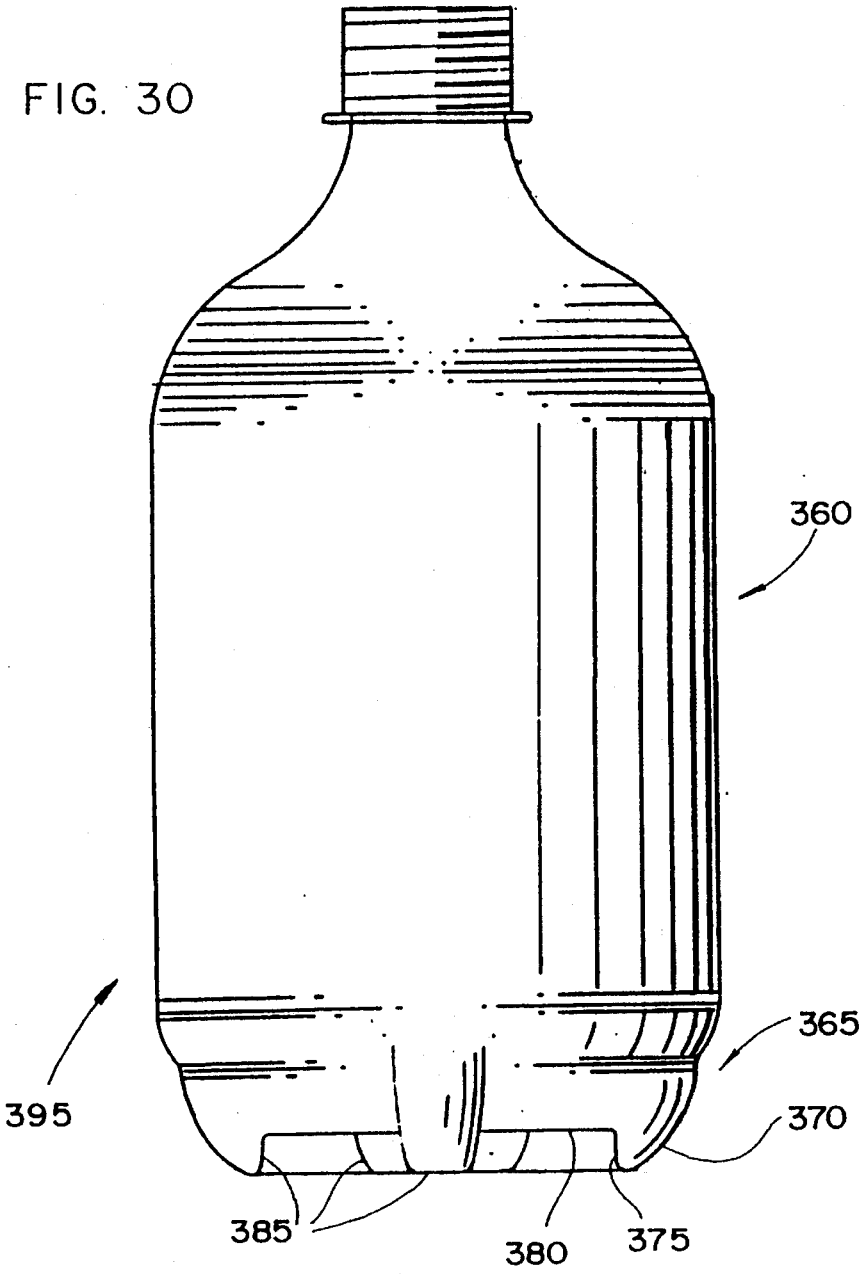
FIG. 30 is a front elevational view of bottle configured for use in the beverage container holder of FIG. 1 according to one embodiment of the present invention.
Figure 31:
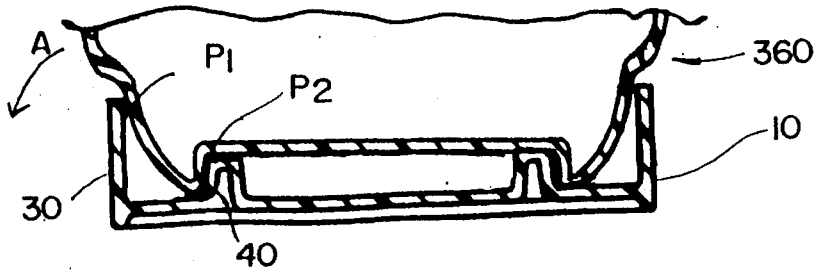
FIG. 31 is a cross-sectional view showing the bottle of FIG. 30 when in use in the holder of FIG. 1.

A bottle configured so as to be receivable in holder 10 is illustrated by FIGS. 30 and 31. Bottle 360 comprises a base portion 365 which includes a base 370 having a substantially vertical surface 375 disposed inwardly from a bottle outer surface and extending upwardly from a bottle lower surface. Base 370 further includes a central base member 380 and a plurality of support feet 385 connected to the outer periphery of central base member 380 and depending therefrom so as to define a lower surface. The inner surface of support feet 385 define substantially vertical surface 375. The outer surface of support feet 385 extend upwards from the lower surface to join with an upper portion 395 of bottle 360. The diameter of base portion 365 where support feet 385 join upper portion 395 generally corresponds that of a standard aluminum can, such that bottle 360 can properly fit within cavity 35 formed in holder 10. Above the height of support feet 385, which generally corresponds to the 0.50 inch height of wall 30 of holder 10, the diameter of bottle 360 is not restricted. Thus, as shown in FIG. 31, when bottle 360 is placed within holder 10 support feet 385 snugly fit between wedging means 40 and wall 30. When bottle 360 is tipped in the direction of arrow A, a wedging force is created between bottle 360 and holder 10 at points P1 and P2. The wedging force holds bottle 360 is an upright position and prevents bottle 360 from tipping over and spilling the contents therein.

Figure 32:
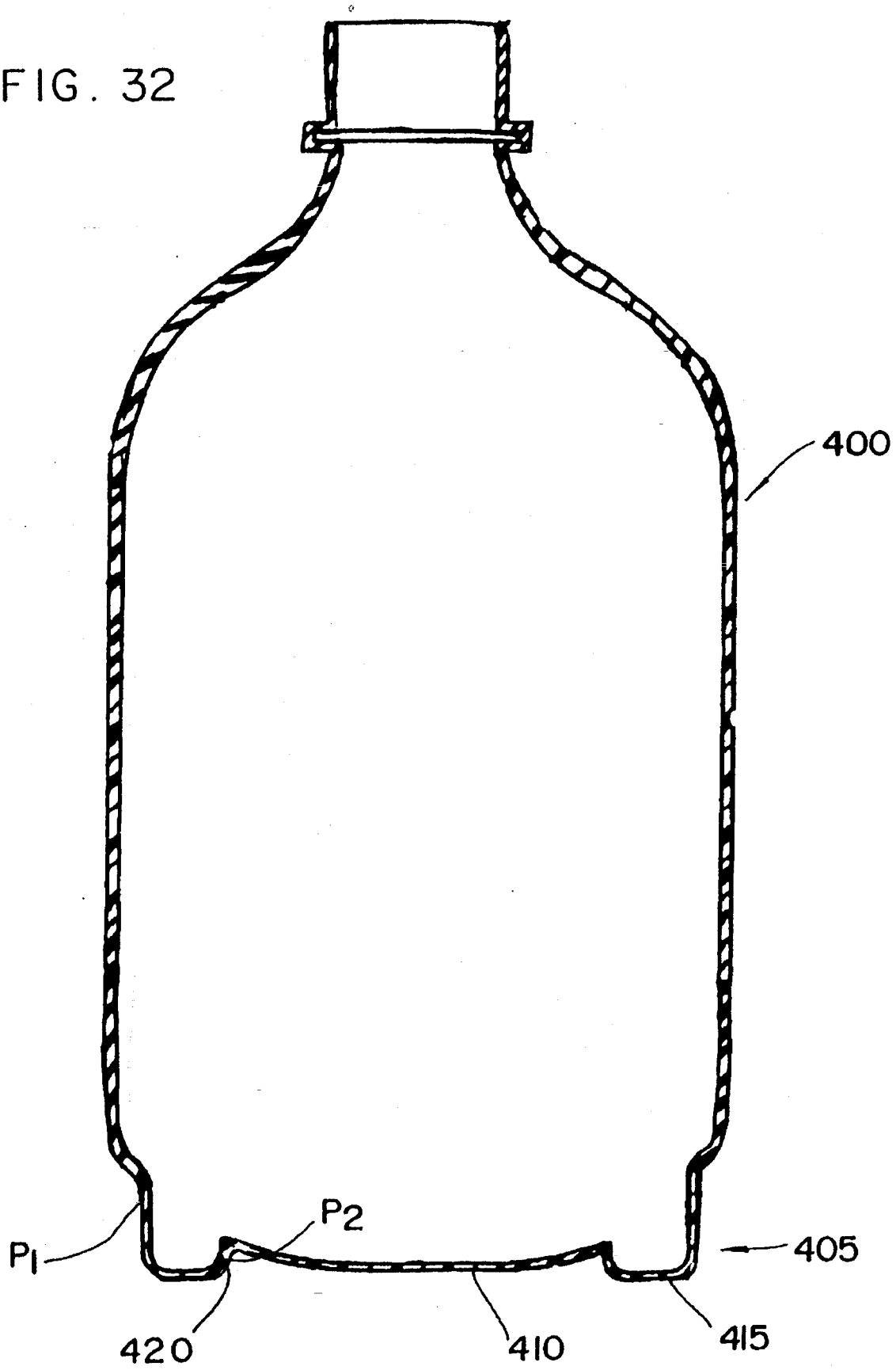
FIG. 32 is a cross-sectional view of a bottle configured for use in the beverage container holder of FIG. 1 according to another embodiment of the present invention.

FIG. 32 illustrates another embodiment for a bottle that is configured so as to be receivable within holder 10. Bottle 400 includes a base 405 similar to that of beverage container support cup 325. Base 405 includes a central base member 410 and an annular surface 415 depending from the periphery of central base member 410 to thereby define a substantially vertical surface 420 which is spaced inwardly from an outer surface of bottle 400 and extends upwardly from a lower surface of bottle 400. In a preferred embodiment, base 405 has a height generally corresponding to the 0.5 inch height of wall 30 of holder 10, however a greater height will not impair the functioning of the invention. Similarly, the diameter of base 405 is configured such that it can be properly fitted within holder 10. Above the 0.5 inch height of base 405, the diameter of bottle 400 is not limited. When bottle 400 is placed within holder 10 and caused to tip such as during the course of normal driving, a wedging action between bottle 400 and holder 10 prevents bottle 400 from further falling and spilling the contents therein. The wedging action occurs at points P1 and P2 due to the interaction of these points with wall 80 and wedging means 40, respectively, of holder 10.

The bottles of the above embodiments are preferably made of plastic, such as polyethylene terephthalate (PET), since this has become particularly popular with the soft drink industry due to its light weight, generally transparent form and low cost. It is, however, within the scope of the present invention to have bottles made of any material capable of being configured so as to have a substantially vertical surface disposed inwardly from an outer surface of the bottle and extending upwardly from a lower surface of the bottle.

Numerous characteristics and advantages of the invention have been described in detail in the foregoing description with reference to the accompanying drawings. However, the disclosure is illustrative only and the invention is not limited to the precise illustrated embodiment. Various changes and modifications may be effected therein by persons skilled in the art without departing from the scope or spirit of the invention.

What is claimed is:

1. A beverage container holder, comprising:

base support means for supporting a beverage container, the container having a base including a substantially vertical surface disposed inwardly from a container outer surface and extending upwardly from a container lower surface;

a wall connected to said base support means and forming therewith a cavity for receiving therein the base of the beverage container, said wall being configured such that the base of the beverage container is loosely disposed in said cavity and removable from said cavity in a vertical direction without substantial frictional resistance, said wall having a top surface; and wedging means secured to said base support means for providing a wedging action upon tilting of the beverage container resting on said base support means, said wedging means having a top surface, said wedging means top surface being spaced a distance below said wall top surface such that wedging between at least the substantially vertical surface of the beverage container and said wedging means thereby restrains the beverage container from further tilting and prevents contents therein from spilling;

wherein said wedging means and said wall are configured and dimensioned relative to one another such that tilting of the beverage container in said cavity causes engagement between the beverage container and said holder at two spaced points of contact occurring at said wall and said wedging means, said two spaced points of contact including a first contact point located at an inner surface of said wall and a second contact point located at an outer surface of said wedging means and at a height a distance below the height of said first contact point; and said wedging means comprises a rib disposed in said cavity and projecting upwards from said base support means.

2. A holder according to claim 1 wherein said rib forms a generally 90° angle with respect to said base support means.

3. A holder according to claim 1 wherein said rib projects approximately 0.140 inch above a top surface of said base support means.

4. A holder according to claim 1 wherein said rib is disposed approximately 0.392 inch interior to said wall.

5. A holder according to claim 1 wherein said wedging means is configured such that said two spaced points of contact occur at an inner surface of said wall and an outer surface of said rib which is facing said wall.

6. A holder according to claim 1 wherein an inner diameter of the cavity defined by said wall is approximately 2.615 inches.

7. A holder according to claim 1 wherein said wall has a height of approximately 0.500 inch above a top surface of said base support means.

8. A holder according to claim 1 wherein said base support means is built into an interior location of an automotive vehicle.

9. A holder according to claim 8 wherein said built-in holder is integrally formed with a top surface of said interior location.

10. A holder according to claim 1 wherein said base support means, said wall, and said wedging means are integrally molded onto a door of an automotive vehicle glove compartment.

11. A holder according to claim 1 wherein said base support means, said wall, and said wedging means are integrally molded onto an automotive vehicle console.

12. A holder according to claim 1 wherein said base support means is secured to a support surface such that said base support means remains fixed relative to said support surface when the beverage container in said cavity is tilted and the beverage container thereby wedges between said wall and said wedging means.

13. A holder according to claim 12 wherein said base support means is removably secured to said support surface by an adhesive tab having a removable protective film.

14. A holder according to claim 1 wherein said base support means, said wedging means, and said wall are integrally formed of a plastics material.

15. A holder according to claim 1 wherein said base support means is circular and said wall extends around the outside periphery thereof to thereby form a circular cavity.

16. A holder according to claim 1 wherein said wall defines a lower surface of said holder and thereby spaces said bottom support member above a support surface when said wall is placed on the support surface.

17. A holder according to claim 1 wherein said beverage container holder is integrally formed on a support structure adapted to be inserted between a seat cushion and a back cushion of an automotive vehicle.

18. A holder according to claim 1 wherein said wedging means is configured such that said two spaced points of contact are located at an inner surface of said wall and an outer surface of said wedging means.

19. A holder according to claim 1 wherein said rib comprises an annular rib defining an open center space on said base support means between opposing sides of said annular rib.

20. A holder according to claim 1 wherein said wedging means allows a tilting angle of the beverage container to be generally no more than eight degrees.

21. A beverage container holder, comprising:

base support means for supporting a beverage container, the container having a base including a substantially vertical surface disposed inwardly from a container outer surface and extending upwardly form a container lower surface;

a wall connected to said base support means and forming therewith a cavity for receiving therein the base of the container, said wall having a top surface; and wedging means secured to said base support means and having a top surface, said wedging means top surface being spaced a distance below said wall top surface for providing a wedging action against at least the substantially vertical surface of the container when the container resting in said cavity is tilted about a vertical axis thereof and to thereby restrain the container from further tilting and prevent contents therein from spilling;

wherein said wedging means and said wall are configured and dimensioned relative to one another such that the base of the container is loosely disposed in said holder and removable from said holder in a vertical direction without substantial frictional resistance but tilting of the container causes an engagement between the container and said holder at two spaced points of contact, said two spaced points of contact including a first contact point located at an inner surface of said wall and a second contact point located at an outer surface of said wedging means and at a height a distance below the height of said first contact point; and said wedging means comprises a rib disposed in said cavity and projecting upward from said base support means and said wedging means.

22. A holder according to claim 21 wherein said wedging means and said wall are configured such that said two spaced points of contact are positioned at an inner surface of said wall and an outer surface of said wedging means.

23. A holder according to claim 21 wherein said base support means is integrally formed with an interior portion of a vehicle.

24. A holder according to claim 21 wherein said base support means, said wall, and said wedging means are integrally molded onto a door of a vehicle glove compartment.

25. A holder according to claim 21 wherein said base support means, said wall, and said wedging means are integrally molded with a vehicle console, comprises a rib disposed in said cavity and projecting upward from said base support means.

26. A holder according to claim 21 wherein said wedging means allows a tilting angle of the container to be generally no more than eight degrees.

27. A holder according to claim 21 wherein said base support means is secured to a support surface such that said base support means remains fixed relative to said support surface when the beverage container in said cavity is tilted and the beverage container thereby wedges between said wall and said wedging means.

28. A beverage container holder, comprising:

base support means for supporting a container, the container having a base including a substantially vertical surface disposed inwardly from a container outer surface and extending upwardly from a container lower surface;

a wall connected to said base support means and forming therewith a cavity for receiving therein the base of the container, said wall having a top surface; and wedging means secured to said base support means and having a top surface, said wedging means top surface being spaced a distance below said wall top surface for providing a wedging action upon tilting of the container resting on said base support means, such that wedging between at least the substantially vertical surface of the container and said wedging means thereby restrains the container from further tilting;

wherein said wedging means and said wall are dimensioned relative to one another such that the base of the container is loosely disposed in the cavity and removable from the cavity in a vertical direction without substantial frictional resistance but tilting of the container in the cavity causes engagement between the container and said holder at two spaced points of contact, said two spaced points of contact including a first contact point located at an inner surface of said wall and a second contact point located at an outer surface of said wedging means and at a height a distance below the height of said first contact point; and said wedging means comprises a rib disposed in said cavity and projecting upward from said base support means.

29. A holder according to claim 28 wherein said wedging means is configured such that said two spaced points of contact are located at an inner surface of said wall and an outer surface of said wedging means.

30. A holder according to claim 28 wherein said wedging means is configured such that said two spaced points of contact are located at an inner surface of said wall and an outer surface of said rib which is facing said wall.

31. A holder according to claim 28 wherein said base support means is integrally formed with an interior portion of a vehicle.

32. A holder according to claim 28 wherein said base support means, said wall, and said wedging means are integrally molded onto a door of a vehicle glove compartment.

33. A holder according to claim 28 wherein said base support means, said wall, and said wedging means are integrally molded with a vehicle console.

34. A holder according to claim 28 wherein said wedging means allows a tilting angle of the container to be generally no more than eight degrees.

35. A holder according to claim 28 wherein said base support means is secured to a support surface such that said base support means remains fixed relative to said support surface when the beverage container in said cavity is tilted and the beverage container thereby wedges between said wall and said wedging means.

36. A beverage container holder, comprising:

a base support having a base surface configured to support a container, the container having a base including a substantially vertical surface disposed inwardly from a container outer surface and extending upwardly from a container lower surface;

a wall connected to said base support and forming therewith a cavity for receiving therein the base of the container, said wall having a top surface; and a wedging rib secured to said base support and having a top surface, said wedging rib top surface being spaced a distance below said wall top surface, said wedging ribs and said wall being configured and dimensioned relative to each other such that the container when supported by said base support is loosely disposed in said cavity and removable from said holder in a vertical direction without substantial frictional resistance and such that tilting of the container in said cavity causes engagement between the container and said holder at two spaced points of contact and thereby prevents further tilting of the container, said two spaced points of contact including a first contact point located at an inner surface of said wall and a second contact point located at an outer surface of said wedging rib and at a height a distance below the height of said first contact point.

37. A holder according to claim 36 wherein said wedging rib is configured such that said two spaced points of contact are located at an inner surface of said wall and an outer surface of said wedging rib.

38. A holder according to claim 36 wherein said wedging rib is disposed in said cavity and projects upward from said base surface.

39. A holder according to claim 36 wherein said wedging rib comprises an annular rib defining an open center space on said base support means between opposing sides of said annular rib.

40. A holder according to claim 36 wherein said base support is integrally formed with an interior portion of a vehicle.

41. A holder according to claim 36 wherein said base support, said wall, and said wedging rib are integrally molded onto a door of a vehicle glove compartment.

42. A holder according to claim 36 wherein said base support, said wall, and said wedging rib are integrally molded with a vehicle console.

43. A holder according to claim 36 wherein said base support, said wall, and said wedging rib are integrally formed.

44. A holder according to claim 36 wherein said wedging rib allows a tilting angle of the container to be generally no more than eight degrees.

45. A holder according to claim 36 wherein said base support means is secured to a support surface such that said base support means remains fixed relative to said support surface when the beverage container in said cavity is tilted and the beverage container thereby wedges between said wall and said wedging rib.

* * * * *

UNITED STATES PATENT AND TRADEMARK OFFICE

CERTIFICATE OF CORRECTION

PATENT NO. : 5,465,891

DATED : November 14, 1995

INVENTOR(S) : John A. BRIDGES

It is certified that error appears in the above-indentified patent and that said Letters Patent is hereby corrected as shown below:

On title page, item [56], "References Cited", column 2, lines 4 and 5, insert

---3,949,876 4/1976 Bridges et al.
4,040,549 8/1977 Sadler
4,120,419 10/1978 Saunders .....220/906
4,127,211 12/1978 Zerby
4,224,764 9/1980 Dziewulski et al. .....248/346.1
4,299,161 11/1981 Collias .....220/632
4,344,530 3/1988 deLarosiere
(List continued on next page.)---.

On title page, item [56], "References Cited", column 2, lines 14-22, delete

"3,949,876 4/1976 Bridges et al.
4,040,549 8/1977 Sadler
4,120,419 10/1978 Saunders .....220/906
4,127,211 12/1978 Zerby
4,224,764 9/1980 Dziewulski et al. .....248/346.1
4,299,161 11/1981 Collias .....220/632
4,344,530 3/1988 deLarosiere
4,467,934 8/1984 Hummer
(List continued on next page.)".

UNITED STATES PATENT AND TRADEMARK OFFICE

CERTIFICATE OF CORRECTION

PATENT NO. : 5,465,891

DATED : November 14, 1995

INVENTOR(S) : John A. BRIDGES

It is certified that error appears in the above-indentified patent and that said Letters Patent is hereby corrected as shown below:

On title page, item [56], "References Cited", column 1, line 1, change "FOREIGN" to ---U.S.---.

At column 7, line 10, change "198 " to ---195---.

At column 7, line 11, after "rib" insert ---45.---.

At column 9, line 61, change "80 " to ---30---.

At column 11, line 53 (claim 21, line 5), change "form " to ---from---.

At column 12, lines 27-29 (claim 25, lines 3-5), delete ", comprises a rib disposed in said cavity and projecting upward from said base support means".

Signed and Sealed this

Thirty-first Day of December, 1996

*Attest:*

*Attesting Officer*

Bruce Lehman

BRUCE LEHMAN

*Commissioner of Patents and Trademarks*